US005129604A

United States Patent [19]

Bagley

[11] Patent Number: 5,129,604

[45] Date of Patent: Jul. 14, 1992

[54] LATERAL THRUST ASSEMBLY FOR MISSILES

[75] Inventor: Cloy J. Bagley, Fountain Valley, Calif.

[73] Assignees: General Dynamics Corporation, Pomona Div., Pomona, Calif.;

[21] Appl. No.: 380,243

[22] Filed: Jul. 17, 1989

[51] Int. Cl.[5] ..... F42B 10/00

[52] U.S. Cl. ..... 244/322; 239/265.15; 239/265.19; 244/3.21

[58] Field of Search ..... 244/3.22, 3.21; 239/265.15, 265.19, 265.25

[56] References Cited

U.S. PATENT DOCUMENTS

| | | | |
|---|---|---|---|
| 2,974,594 | 3/1961 | Boehm | 102/50 |
| 3,112,612 | 12/1963 | Adamson et al. | 60/35.6 |
| 3,210,937 | 10/1965 | Perry, Jr. | 60/229 |
| 3,294,344 | 12/1966 | Rosen et al. | 244/1 |
| 3,358,453 | 12/1967 | Swet | 60/225 |
| 3,532,297 | 10/1970 | Maes | 244/1 |
| 3,563,466 | 2/1971 | Clark et al. | 239/265.15 |
| 3,802,190 | 4/1974 | Kaufmann | 60/225 |
| 3,968,646 | 7/1976 | Betts et al. | 60/271 |
| 4,017,040 | 4/1977 | Dillinger et al. | 244/3.22 |
| 4,345,729 | 8/1982 | Barter | 244/169 |
| 4,384,690 | 5/1983 | Brodersen | 244/3.22 |
| 4,589,594 | 5/1986 | Kranz | 239/265.25 |
| 4,826,104 | 5/1989 | Bennett et al. | 244/3.22 |
| 4,856,734 | 8/1989 | Davies | 244/3.22 |

FOREIGN PATENT DOCUMENTS 2094240A 9/1962 United Kingdom .

*Primary Examiner*—Charles T. Jordan
*Assistant Examiner*—Rochelle Lieberman
*Attorney, Agent, or Firm*—Neil F. Martin; Leo R. Carroll

[57] ABSTRACT

A lateral thrust assembly for missile maneuvering comprises an annular array of outwardly directed nozzles, each nozzle having a releasable plug normally blocking flow of propellant gases out of the nozzle. A plug release mechanism associated with each plug allows that plug to be released to open the respective nozzle. A combustion chamber containing propellant is connected to the inner ends of all the nozzles. The propellant is ignited when one or more selected plugs are released to allow opening of the associated nozzle or nozzles, controlling the direction of the lateral thrust applied to the vehicle.

10 Claims, 2 Drawing Sheets

LATERAL THRUST ASSEMBLY FOR MISSILES

BACKGROUND OF THE INVENTION

This application relates generally to missiles and other airborne vehicles and is particularly concerned with a lateral thrust assembly for such vehicles.

Defensive type missiles are generally required to intercept targets which will typically be moving at high velocities, will possibly be designed to be "stealthy", and may also be able to maneuver at relatively high levels. These features make it difficult for the defensive missile to guide onto the target and make the terminal maneuver times extremely short. They also require the defensive missile itself to have exceptionally high maneuvering capability, in other words it must be able to change course laterally in any direction very rapidly.

Similarly, offensive type missiles should be able to move laterally at the last instant to avoid intercept. Lateral maneuvers are normally achieved by causing lateral forces to develop on the missile by means of deflecting control surfaces. However, these are normally aerodynamic related forces that are developed relatively slowly and cannot be used for a last instant, rapid course change. Also, these aerodynamic produced lateral forces become less effective at high altitude.

SUMMARY OF THE INVENTION

It is an object of the present invention to provide an improved lateral thrust assembly for a missile or other airborne vehicle which can cause a rapid lateral maneuver of the vehicle.

According to the present invention, a lateral thrust assembly for lateral maneuvering of an airborne vehicle such as a missile is provided, which comprises an annular array of outwardly directed nozzles, each nozzle containing a releasable plug which normally blocks the flow of exhaust gases out of the nozzle, a propellant supply for supplying propellant gases to the inner ends of all the nozzles, and plug release devices associated with the nozzles for selectively releasing one or more of the nozzles to allow opening of the associated nozzles.

A suitable control system is provided to control propellant ignition and release of selected nozzle plugs according to the desired direction and magnitude of thrust. The plug release devices may, for example, comprise explosive charges embedded in each of the plugs, the plugs being of a suitable frangible material which is shattered on detonation of the charge and blown out of the nozzle by the propellant gases. Alternatively, retractable retainer devices may be used which normally block movement of the plugs out of the nozzle and which are selectively retracted to allow the propellant gases to propel the released plugs out of the associated nozzles.

Preferably, the nozzle array forms an intermediate part of the cylindrical body of a missile or other vehicle between the nose or forward portion of the missile and the missile main propulsion section. Alternatively, it may be of doughnut shape mounted to surround part of the missile body.

When a lateral maneuver is required, as determined by the missile guidance system, for example, the lateral thruster propellant is ignited while one or more nozzle plugs are released. The high pressure gases generated in a combustion chamber containing the propellant flow out of the combustion chamber and out of any open nozzles or nozzles in which the plug has been released. Lateral forces are created on the missile in a direction opposite to the resultant of the exhausts from the open nozzles. The nozzles may be sized such that the desired magnitude of thrust is created by opening of any one nozzle. However, for varying the thrust magnitude, smaller nozzles may be provided so that two or more nozzles may be opened, allowing control of both the direction and magnitude of the lateral thrust.

The propellant is preferably located in a suitable combustion chamber to one side of the nozzle array and connected to the center of the array. Combustion chambers may be provided on both sides of the array for even faster operation. If space is critical, propellant may also be packed in the center of the nozzle array to reduce axial space requirements.

The lateral thrust assembly may be provided on missiles and other airborne projectiles or vehicles to allow rapid lateral translation in any desired direction. Control of the direction may be provided from the ground or via an on-board tracking and guidance system.

BRIEF DESCRIPTION OF THE DRAWINGS

The present invention will be better understood from the following detailed description of a preferred embodiment, taken in conjunction with the accompanying drawings, in which like references refer to like parts, and in which.

DESCRIPTION OF THE PREFERRED EMBODIMENT

Figure 1:
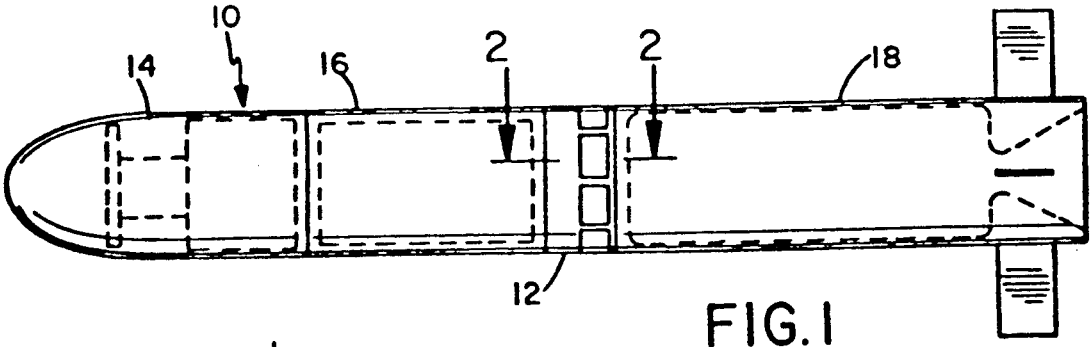
FIG. 1 is a side elevation view of a typical missile incorporating the lateral thruster according to a preferred embodiment of the invention.

FIG. 1 of the drawings illustrates a typical missile 10 incorporating a lateral thrust assembly 12 according to a preferred embodiment of the present invention. Although the thrust assembly is shown incorporated in a missile in the preferred embodiment described, it is also applicable to any airborne vehicle or projectile where rapid lateral maneuvers may be desirable.

The missile has a generally cylindrical body incorporating a forward guidance section 14, a warhead 16, and a main propulsion section 18. The lateral thruster assembly 12 comprises a cylindrical body section 20 between the warhead and propulsion section, and has a cylindrical contour matching that of the remainder of the missile so that it blends into the external contour of the missile body. Although the thrust assembly 12 is shown as a body segment in FIG. 1, it may alternatively be built around the other components of the vehicle or missile in a doughnut fashion, for example.

Figure 2:
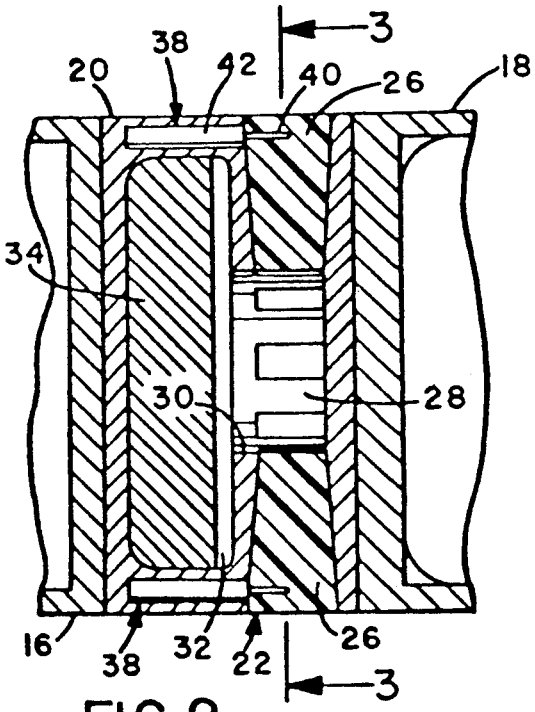
FIG. 2 is an enlarged sectional view taken on line 2—2 of FIG. 1.
Figure 3:
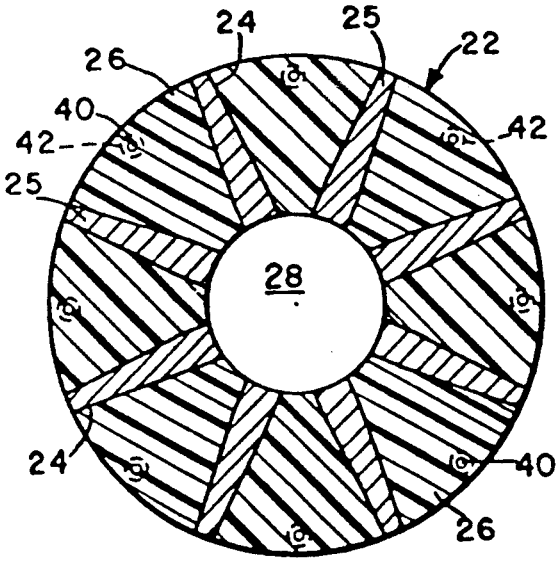
FIG. 3 is a sectional view taken on line 3—3 of FIG. 2.

As illustrated in FIGS. 2 and 3, the thrust assembly 12 basically comprises an annular array or ring 22 of nozzles 24 each containing a removable plug 26 which normally blocks the flow of exhaust gases out of the nozzles. Each nozzle comprises a segment of annular ring 22 separated from the next adjacent sections by common walls or dividers 25. The nozzles are open at their inner and outer ends, as illustrated in FIG. 3. The array has a central opening 28 which communicates via an axial passageway 30 with a combustion chamber 32 located to one side of the array. The combustion chamber 32 contains a suitable propellant 34. A propellant igniter 36 (see FIG. 4) of a standard type will be provided in chamber 32. If axial space is limited, the propellant may be located in center opening 28 of the nozzle array instead of in a separate chamber to one side of the array. For faster operation, combustion chambers may be provided on each side of the array with passageways connecting the chambers to the center of the array.

Plug release devices 38 are associated with each of the plugs to control opening of the associated nozzle. Any suitable release device may be used. FIGS. 2 and 3 show one possible arrangement where each release device comprises a retractable retaining pin 40 which normally projects into the associated plug 26. A pin retractor 42 such as a solenoid device is arranged to withdraw the pin 40 from the plug 26 when desired, as explained in more detail below.

Figure 8:
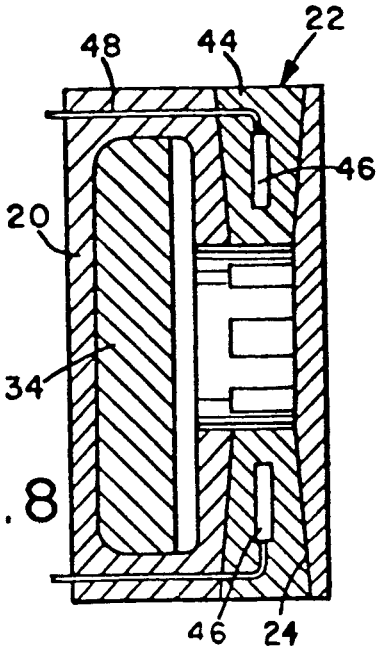
FIG. 8 is a view similar to FIG. 2, showing an alternative nozzle plug and separation means.

Alternative plug release devices are illustrated in FIG. 8, where each of the plugs 44 is of a frangible material, and the release devices each comprise an explosive cap 46 embedded in the associated plug and connected via line 48 to a suitable control device for detonating the cap. Alternatively, the plug may be secured by a suitable pyrotechnic release nut to the nozzle wall via a suitable vane structure, for example. An electrical signal from the missile autopilot then detonates nut as desired, severing the connection and releasing the plug.

In FIG. 3 the thrust assembly comprises eight nozzles. However, a greater or lesser number of nozzles may be provided according to the degree of thrust direction and magnitude of control desired.

Figure 4:
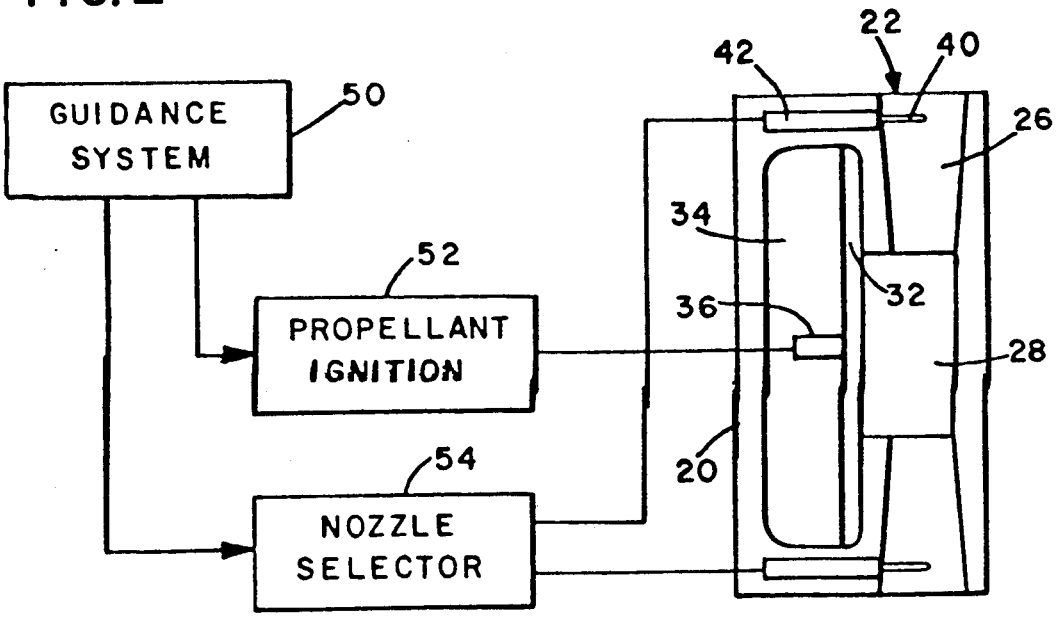
FIG. 4 is a schematic of the lateral thruster actuating system.

FIG. 4 is a schematic illustrating a suitable control system for actuating the lateral thrust assembly. A suitable guidance system 50, which may be the missile main guidance system or a separate system for operating the lateral thrust assembly only, senses the attitude changes needed to intercept a target or change a vehicle trajectory. When a last minute lateral maneuver is required, the system 50 actuates a propellant ignition assembly 52 which controls igniter 36 to ignite the propellant 34. Simultaneously, or just prior to, the propellant ignition, the desired nozzle or nozzles are released or opened by nozzle selector assembly 54 which is connected by suitable electrical interfaces to the respective release devices and actuates the appropriate pin retractors 42.

Figure 5:
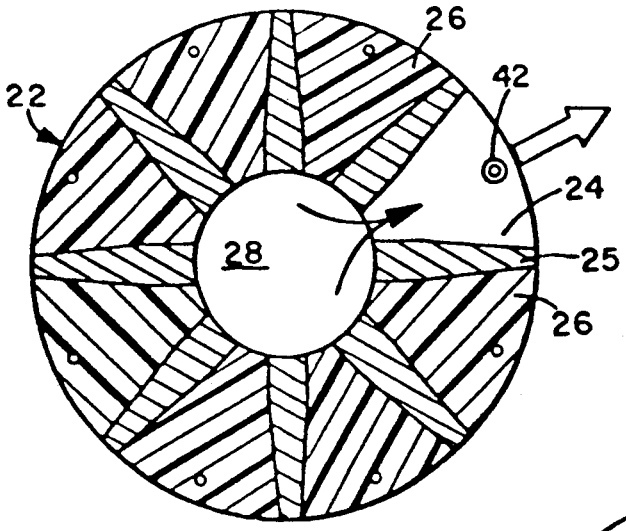
FIG. 5 is a view similar to FIG. 3, showing one lateral nozzle in use.
Figure 6:
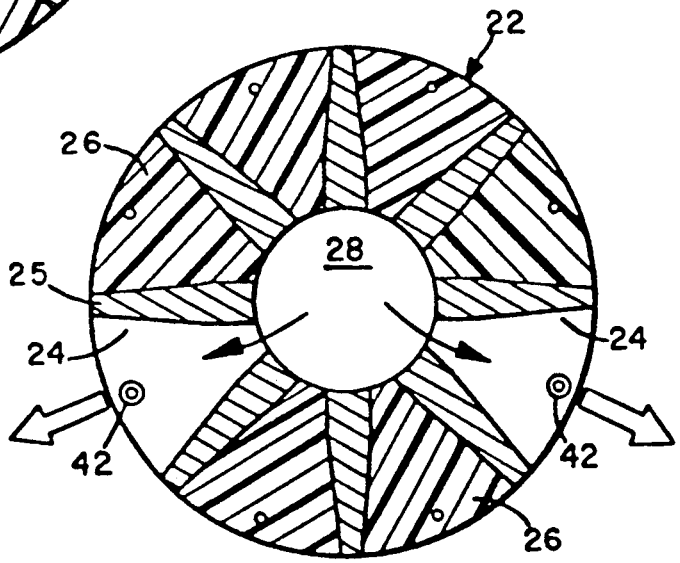
FIG. 6 is a similar view with a spaced pair of nozzles in use.
Figure 7:
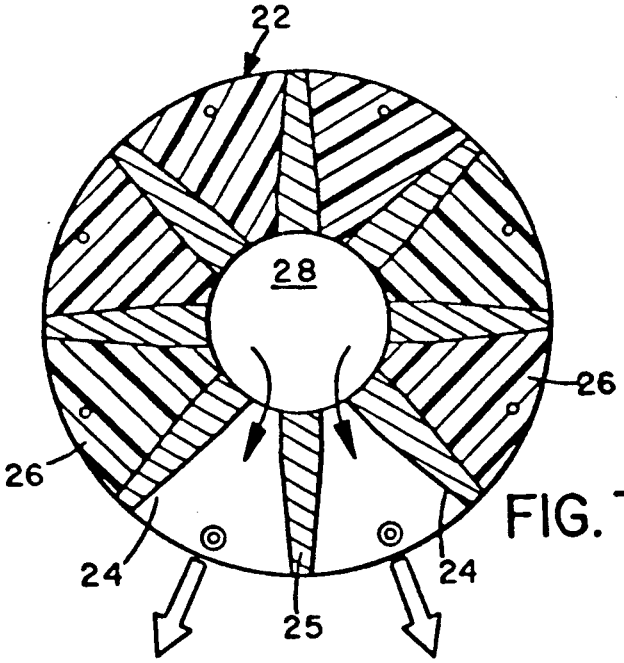
FIG. 7 is a similar view with an adjacent pair of nozzles in use.

In the case of the release devices illustrated in FIGS. 2 and 3, pins 40 in the selected nozzles will be retracted, so that propellant gases will blow the associated released plugs out of the nozzles as illustrated in FIGS. 5 to 7. Alternatively, the plugs may be released by detonation of a pyrotechnic release nut, as discussed above. The plugs are suitably designed to be blown out by the propellant gases when released. In the case of an explosive release mechanism as illustrated in FIG. 8, explosion of caps 48 in the selected plugs will disintegrate the frangible material of the plugs, opening the associated nozzles.

FIG. 5 illustrates a situation in which one nozzle has been selected. In this example, lateral forces will be created on the missile in a direction opposite to the arrow, representing the blast, in FIG. 5. FIG. 6 illustrates a situation in which two non-adjacent nozzles have been opened. In this case, the lateral forces created will be in a direction opposite to the resultant of the blasts out of the two nozzles. In FIG. 7, two adjacent nozzles have been opened to increase the thrust magnitude in a direction opposite to the resultant of the blasts out of both nozzles.

The guidance system can be suitably programmed in a manner generally known in the field with the thrust directions and magnitudes resulting from opening any possible combination of one or more nozzles in the array. Thus, when the desired directional change is known from sensor information or ground control, the nozzle or nozzles necessary to produce that directional change can be opened rapidly.

If the thrust assembly is located at or near the missile center of gravity the missile can be made to translate laterally with little change in its pitch and yaw. That is, the missile can change its flight path yet remain pointed at the target. Even if the missile has slowed down considerably or attained a relatively high altitude these lateral forces can be generated at essentially the same magnitude.

When the thrust assembly is located slightly forward of the missile center of gravity, it can cause the missile to translate laterally and help produce missile aerodynamic angle-of-attack as well. Again, the magnitude is essentially constant with missile velocity and altitude.

When the thrust assembly is located well forward or aft of the missile center of gravity it provides mostly pitch and yaw steering forces. These steering forces are, as expected, essentially constant with missile velocity and altitude. They also remain essentially constant with missile aerodynamic angle-of-attack.

The response time of a missile is a measure of how fast it can execute a maneuver which is related to how rapidly it can develop lateral forces. Previously, for a typical missile, a maneuver sequence started with the deflection of control surfaces. This caused steering forces which make the missile pitch or yaw to an aerodynamic angle-of-attack which causes the necessary lateral forces.

The present invention improves missile response time because lateral forces can be developed almost instantly when the thrust assembly is ignited. There is no delay for the missile to develop an aerodynamic angle-of-attack. Also the fact that the thruster is effective at all aerodynamic angles-of-attack, missile velocities and altitudes results in faster response times.

The lateral thrust assembly may be used for terminal, last instant maneuvers, but may also be used for course corrections at any time, and may be designed with a gradual thrust versus time profile, for example by opening gradually increasing numbers of nozzles. The assembly is of compact and simple design, is not altitude dependent, and has few or no moving parts. The assembly allows maneuvering at any altitude at the last instant when guidance information improves, reducing the risk of missing the target.

Although a preferred embodiment of the invention has been described above by way of example only, it will be understood by those skilled in the field that modifications may be made to the disclosed embodiment without departing from the scope of the invention, which is defined by the appended claims.

I claim:

1. A lateral thrust assembly for maneuvering of an airborne vehicle during flight, comprising:

an annular array of outwardly directed nozzles;

a plug extending across each nozzle for normally blocking flow of thrust gases out of the nozzle;

plug release means for selectively releasing one or more plugs to allow opening of the associated nozzles; and propellant supply means for supplying propellant gases to the inner ends of all the nozzles for exhaust out of any nozzles in which the plug has been released.

2. The assembly as claimed in claim 1, wherein said plug release means comprises a retainer mechanism associated with each plug, the retainer mechanism being movable between an operative position blocking movement of the plug out of the nozzle and an inoperative position releasing the plug to be blown out of the nozzle by propellant gases.

3. The assembly as claimed in claim 1, wherein said plug release means comprises explosive means associated with each plug for disintegrating the associated plug to open the respective nozzle.

4. The assembly as claimed in claim 1, including a cylindrical housing section for forming part of a missile body, said array comprising part of said housing section, and said housing section having a combustion chamber containing propellant, and connecting means connecting said combustion chamber to the center of said annular array.

5. The assembly as claimed in claim 1, wherein said propellant supply means comprises a combustion chamber connected to the inner ends of all the nozzles, propellant material in said combustion chamber, and igniter means for igniting said propellant material.

6. The assembly as claimed in claim 4, wherein said combustion chamber is located in said housing section to one side of said annular array, said array having a central opening, and an axial passageway connecting said combustion chamber to said central opening.

7. The assembly as claimed in claim 1, including control means for controlling the supply of propellant gases to the inner ends of all the nozzles and for controlling the actuation of selected plug release means to open selected nozzles.

8. The assembly as claimed in claim 1, wherein the nozzles are directed radially outwardly.

9. A missile having a generally cylindrical body including a forward section, a rear propulsion section, and an intermediate lateral thrust section, the lateral thrust section comprising an annular array of outwardly directed nozzles, a plug in each nozzle normally blocking flow of propellant gases out of the nozzle, plug release means for selectively releasing one or more of the plugs to allow opening of the associated nozzle, a combustion chamber connected to the inner ends of all of the nozzles, and propellant means in said combustion chamber for supplying propellant gases to the nozzles after ignition for exhaust out of any nozzles in which the plug has been released.

10. A lateral thrust assembly for maneuvering of an airborne vehicle during flight, comprising:

an annular array of outwardly directed nozzles having open inner ends;

propellant supply means for supplying propellant gases to the inner ends of all the nozzles after ignition;

plug means extending across each nozzle for normally resisting flow of propellant gases through the nozzle after ignition; and plug release means associated with each nozzle for selectively releasing one or more of the plug means at or before ignition to allow opening of the selected nozzles and exhaust of propellant gases out of only those nozzles in which the plug means has been released.

* * * * *